US010928007B2

(12) United States Patent
Posselt et al.

(10) Patent No.: US 10,928,007 B2
(45) Date of Patent: Feb. 23, 2021

(54) TRANSPORT CONTAINER

(71) Applicant: LINDE AKTIENGESELLSCHAFT, Munich (DE)

(72) Inventors: Heinz Posselt, Bad Aibling (DE); Philip Werner, Askim (SE); Marko Parkkonen, Ytterby (SE); Anders Gronlund, Hovas (SE); Stefan C. Agren, Gothenburg (SE); Martin Smedstad, Gothenburg (SE)

(73) Assignee: LINDE AKTIENGESELLSCHAFT, Munich (DE)

( * ) Notice: Subject to any disclaimer, the term of this patent is extended or adjusted under 35 U.S.C. 154(b) by 83 days.

(21) Appl. No.: 16/098,655

(22) PCT Filed: Apr. 28, 2017

(86) PCT No.: PCT/EP2017/025100

§ 371 (c)(1),
(2) Date: Nov. 2, 2018

(87) PCT Pub. No.: WO2017/190846

PCT Pub. Date: Nov. 9, 2017

(65) Prior Publication Data

US 2019/0145580 A1 May 16, 2019

(30) Foreign Application Priority Data

May 4, 2016 (EP) ..... 16000999

(51) Int. Cl.
*F17C 3/10* (2006.01)
*F17C 1/12* (2006.01)
*F17C 13/00* (2006.01)

(52) U.S. Cl.
CPC ..... *F17C 3/10* (2013.01); *F17C 1/12* (2013.01); *F17C 13/001* (2013.01);
(Continued)

(58) Field of Classification Search
CPC ..... F17C 2203/014; F17C 2221/017; F17C 2203/01; Y10S 220/92; B65D 88/128
See application file for complete search history.

(56) References Cited

U.S. PATENT DOCUMENTS 2,592,974 A * 4/1952 Sulfrian ..... F17C 13/086 220/560.1
2,729,357 A * 1/1956 Nason, Jr. ..... A47J 41/028 220/560.05

(Continued)

FOREIGN PATENT DOCUMENTS

DE 2903787 A1 8/1980
EP 0260036 A2 3/1988

OTHER PUBLICATIONS

International Search Report for PCT/EP2017/025100 dated Oct. 19, 2017.

*Primary Examiner* — Shawn M Braden
(74) *Attorney, Agent, or Firm* — Millen White Zelano & Branigan, PC; Brion P. Heaney

(57) ABSTRACT

A transport container for helium, having an inner container for receiving helium, a thermal shield actively coolable with the aid of a cryogenic liquid and in which the inner container is accommodated, an outer container in which the thermal shield and inner container are accommodated, and a carrying ring provided on the thermal shield. The inner container is suspended from the carrying ring with the aid of first suspension rods, wherein the carrying ring is suspended from the outer container with the aid of second suspension rods, wherein at least one of the first suspension rods has a first spring device and at least one of the second suspension devices has a second spring device in order to ensure a spring pretension of the first suspension rods and the second suspension rods for different heat expansions of the inner container and the thermal shield.

20 Claims, 4 Drawing Sheets

(52) U.S. Cl.
CPC ..... *F17C 2201/0109* (2013.01); *F17C 2201/0166* (2013.01); *F17C 2201/035* (2013.01); *F17C 2201/054* (2013.01); *F17C 2203/015* (2013.01); *F17C 2203/016* (2013.01); *F17C 2203/032* (2013.01); *F17C 2203/035* (2013.01); *F17C 2203/0308* (2013.01); *F17C 2203/0312* (2013.01); *F17C 2203/0316* (2013.01); *F17C 2203/0345* (2013.01); *F17C 2203/0366* (2013.01); *F17C 2203/0387* (2013.01); *F17C 2203/0391* (2013.01); *F17C 2203/0629* (2013.01); *F17C 2203/0643* (2013.01); *F17C 2221/014* (2013.01); *F17C 2221/017* (2013.01); *F17C 2223/0161* (2013.01); *F17C 2223/033* (2013.01); *F17C 2227/0381* (2013.01); *F17C 2260/033* (2013.01); *F17C 2270/01* (2013.01)

(56) References Cited

U.S. PATENT DOCUMENTS 3,004,683 A * 10/1961 Schoch ..... F17C 13/086 220/560.1
3,155,265 A * 11/1964 Reese ..... F17C 3/022 220/560.05
3,446,388 A * 5/1969 Greenberg ..... F17C 13/086 220/562
3,782,128 A 1/1974 Hampton et al.
4,300,354 A 11/1981 Buchs et al.
4,777,807 A 10/1988 White
RE33,419 E 11/1990 White
8,272,530 B2 * 9/2012 Rebernik ..... F17C 3/08 220/560.05
2007/0084221 A1 * 4/2007 Ruocco-Angari .... G01J 5/0205 62/51.1
2007/0228048 A1 * 10/2007 Immel ..... F17C 13/021 220/560.1
2010/0011782 A1 1/2010 Matthias
2019/0145580 A1 * 5/2019 Posselt ..... F17C 13/001 220/560.12

* cited by examiner

TRANSPORT CONTAINER

The invention relates to a transport container for helium.

Helium is extracted together with natural gas. For economic reasons, transport of large amounts of helium is expedient only in a liquid or supercritical form, that is to say at a temperature of approximately 4.2 to 6 K and under a pressure of 1 to 6 bar. For transporting the liquid or supercritical helium, use is made of transport containers which, to avoid the pressure of the helium increasing too rapidly, are provided with sophisticated thermal insulation. Such transport containers may be cooled for example with the aid of liquid nitrogen. This involves providing a thermal shield cooled with the liquid nitrogen. The thermal shield shields an inner container of the transport container. The liquid or cryogenic helium is accommodated in the inner container. The holding time for the liquid or cryogenic helium in the case of such transport containers is 35 to 40 days, that is to say after this time, the pressure in the inner container has increased to the maximum value of 6 bar. The supply of liquid nitrogen is sufficient for approximately 35 days.

EP 1 673 745 B1 describes such a transport container for liquid helium. The transport container comprises an inner container in which the liquid helium is accommodated, a thermal shield which partially covers the inner container, a coolant container in which a cryogenic liquid for cooling the thermal shield is accommodated, and an outer container in which the inner container, the thermal shield and the coolant container are arranged.

U.S. Pat. No. 3,782,128 A presents a transport container for helium, having an inner container for receiving the helium, a thermal shield which is actively coolable with the aid of a cryogenic liquid and in which the inner container is accommodated, an outer container in which the thermal shield and the inner container are accommodated, and a stiffening ring provided on the thermal shield.

US 2010/0011782 A1 describes a transport container for helium, having an inner container for receiving the helium, a thermal shield in which the inner container is accommodated, and an outer container in which the thermal shield and the inner container are accommodated. The inner container is suspended directly from the outer container with the aid of struts.

Against this background, the object of the present invention is to provide an improved transport container.

Accordingly, a transport container for helium is proposed. The transport container comprises an inner container for receiving the helium, a thermal shield which is actively coolable with the aid of a cryogenic liquid and in which the inner container is accommodated, an outer container in which the thermal shield and the inner container are accommodated, and a carrying ring provided on the thermal shield, wherein the inner container is suspended from the carrying ring with the aid of first suspension rods, wherein the carrying ring is suspended from the outer container with the aid of second suspension rods, wherein at least one of the first suspension rods has a first spring device and at least one of the second suspension rods has a second spring device in order to ensure a spring pretension of the first suspension rods and the second suspension rods for different heat expansions of the inner container and the thermal shield.

The inner container may also be referred to as a helium container or inner tank. The transport container may also be referred to as a helium transport container. The helium may be referred to as liquid or cryogenic helium. The helium is in particular likewise a cryogenic liquid. The transport container is in particular set up to transport the helium in a cryogenic or liquid form or in a supercritical form. In thermodynamics, the critical point is a thermodynamic state of a substance that is characterized by the densities of the liquid phase and the gas phase becoming identical. At this point, the differences between the two states of aggregation cease to exist. In a phase diagram, the point is the upper end of the vapor pressure curve. The helium is introduced into the inner container in a liquid or cryogenic form. A liquid zone with liquid helium and a gas zone with gaseous helium then form in the inner container. Therefore, after being introduced into the inner container, the helium has two phases with different states of aggregation, namely liquid and gaseous. That is to say, there is a phase boundary between the liquid helium and the gaseous helium in the inner container. After a certain time, that is to say when the pressure in the inner container increases, the helium situated in the inner container becomes single-phase. The phase boundary then no longer exists and the helium is supercritical.

The cryogenic liquid or the cryogen is preferably liquid nitrogen. The cryogenic liquid may alternatively also be for example liquid hydrogen or liquid oxygen. The statement that the thermal shield is actively coolable or actively cooled is to be understood as meaning that the thermal shield is at least partially flowed through or flowed around by the cryogenic liquid in order to cool it. In particular, the thermal shield is actively cooled only in an operating state, that is to say when the inner container is filled with helium. When the cryogenic liquid has been used up, the thermal shield may also be uncooled. During the active cooling of the thermal shield, the cryogenic liquid can boil and evaporate. As a result, the thermal shield is at a temperature which corresponds approximately or exactly to the boiling point of the cryogenic liquid. The boiling point of the cryogenic liquid is preferably higher than the boiling point of the liquid helium.

Preferably, the inner container is, on the outside, at a temperature which corresponds approximately or exactly to the temperature of the helium. The outer container, the inner container and the thermal shield may be constructed rotationally symmetrically in relation to a common axis of symmetry or center axis. The inner container and the outer container are preferably produced from high-grade steel. The inner container preferably has a tubular base portion, which is closed on both sides by curved cover portions. The inner container is fluid-tight. The outer container preferably likewise has a tubular base portion, which is closed at each of the two end faces by cover portions. The base portion of the inner container and/or the base portion of the outer container may have a circular or approximately circular cross section. The thermal shield is preferably produced from a high-purity aluminum material.

The fact that the thermal shield is provided ensures that the inner container is surrounded only by surfaces which are at a temperature corresponding to the boiling point of the cryogenic liquid (boiling point of nitrogen at 1.3 bara: 79.5 K). As a result, there is only a small difference in temperature between the thermal shield (79.5 K) and the inner container (temperature of the helium: 4.2 to 6 K) in comparison with the surroundings of the outer container. This allows the holding time for the liquid helium to be lengthened significantly in comparison with known transport containers. The heat exchange between the surfaces of the inner container and the thermal shield is in this case realized only by radiation and residual gas conduction. That is to say, the thermal shield makes no contact with the inner container.

During the start-up of the transport container, initially the thermal shield is cooled down, with the inner container initially not yet being filled with helium. In this way, the residual vacuum gas is frozen out on the thermal shield and thus does not contaminate the metallically bright outermost layer of an insulating element provided on the inner container. At an end of the inner container which is opposite the first and the second suspension rods, said inner container is axially fastened to the thermal shield and/or the outer container. That is to say, a fixed bearing is provided here. The cooling of the thermal shield can result in thermally induced stresses being applied to the suspension rods. These thermal stresses, brought about by the relative movement between the thermal shield and the inner container, are significantly larger than those stresses which occur at the operating temperature of the transport container. These stresses are dominated by the difference between the thermal expansion coefficients of the materials of the inner container and the thermal shield.

These stresses during the start-up of the transport container can no longer be absorbed by an elastic deformation of the suspension rods. Rather, a plastic deformation, that is to say a lasting extension of the suspension rods, occurs. In the case of extended suspension rods, the inner container can partly sag at the operating temperature, with those suspension rods which are arranged below a center axis of the outer container with respect to a direction of gravitational force becoming loose.

Transverse forces acting on the inner container are thus able to be absorbed only after movement of the inner container, as a result of which additional acceleration forces can be brought about. This can be reliably prevented by providing the spring devices on the first suspension rods and the second suspension rods. With the aid of the spring devices, it is possible to elastically absorb the necessary change in length of the suspension rods during the start-up of the transport container. With the aid of the spring devices, the elasticity of the suspension rods is thus artificially increased. Here, the spring devices are dimensioned such that, due to them, the suspension rods are deformed plastically only to an insignificant extent during the start-up of the transport container. By contrast, in the operating state of the transport container, the spring devices provide enough tensile force to be able to elastically absorb the transverse forces.

According to one embodiment, the first suspension rods and the second suspension rods are in each case arranged in a star shape.

Preferably, the suspension rods are in each case tension rods. The first suspension rods and the second suspension rods may in each case be arranged so as to be distributed uniformly or non-uniformly around a circumference of the carrying ring.

According to a further embodiment, the first spring device and the second spring device each have multiple disk spring elements.

In particular, the spring devices are each formed as disk spring element assemblies. Here, there may be any number of disk spring elements per spring device. Alternatively, it is also possible for the spring devices to be formed as cylindrical springs, in particular as tension springs.

According to a further embodiment, in each case four first suspension rods and four second suspension rods are provided.

There may be any number of suspension rods. Preferably, however, at least three first suspension rods and three second suspension rods are provided. Alternatively, it is also possible for more than four first suspension rods and more than four second suspension rods to be provided. The number of the first suspension rods may differ from the number of the second suspension rods.

According to a further embodiment, the at least one first suspension rod which has the first spring device is arranged below a center axis of the outer container with respect to a direction of gravitational force.

The first suspension rods which are arranged above the center axis with respect to the direction of gravitational force are held under tension by the weight force of the inner container. Said suspension rods therefore do not have any spring devices.

According to a further embodiment, two first suspension rods which each have a first spring device are arranged below the center axis of the outer container with respect to the direction of gravitational force.

Preferably, it is also the case that two first suspension rods without such a first spring device are positioned above the center axis of the outer container with respect to the direction of gravitational force.

According to a further embodiment, the at least one second suspension rod which has the second spring device is arranged below the center axis of the outer container with respect to the direction of gravitational force.

The second suspension rods which are arranged above the center axis with respect to the direction of gravitational force are held under tension by the weight force of the inner container. Said suspension rods therefore do not have any spring devices.

According to a further embodiment, two second suspension rods which each have a second spring device are arranged below the center axis of the outer container with respect to the direction of gravitational force.

Preferably, it is also the case that two second suspension rods without such a second spring device are arranged above the center axis of the outer container with respect to the direction of gravitational force.

According to a further embodiment, the carrying ring has pockets in which the second suspension rods are arranged.

Proceeding from the carrying ring, the pockets are preferably oriented radially inward in the direction of the center axis. The provision of pockets allows the second suspension rods to be formed to be as long as possible. In this way, the heat transport path from the carrying ring toward the outer container is lengthened. This allows the heat input from the outer container into the carrying ring to be reduced significantly.

According to a further embodiment, the inner container has a fastening flange to which the first suspension rods are fastened.

The fastening flange is preferably cylindrical. The fastening flange is in particular rotationally symmetric with respect to a center axis of the inner container. The center axis of the outer container may be identical to the center axis of the inner container.

With the aid of eyelets provided on the fastening flange, the first suspension rods may be hooked into said flange.

According to a further embodiment, the carrying ring, the first suspension rods and the second suspension rods are assigned to a first cover portion of the inner container.

The first cover portion is preferably positioned so as to face away from a coolant container, likewise arranged in the outer container, of the transport container.

According to a further embodiment, the inner container is suspended at a second cover portion from the thermal shield with the aid of third suspension rods, wherein the thermal shield is suspended from the outer container with the aid of fourth suspension rods.

For this purpose, a further carrying ring, from which the inner container is suspended with the aid of third suspension rods, may be provided as part of the coolant container. The carrying ring may be suspended from the outer container with the aid of the fourth suspension rods. Preferably, four such third suspension rods arranged in a star shape and four such fourth suspension rods arranged in a star shape are provided. Preferably, the third and fourth suspension rods in each case do not have a spring device. The third and fourth suspension rods form a fixed bearing of the inner container.

According to a further embodiment, the third suspension rods and the fourth suspension rods are led through a coolant container in which the cryogenic liquid is accommodated.

Preferably, the third suspension rods and the fourth suspension rods are led through the coolant container in a manner parallel to a direction of gravitational force.

According to a further embodiment, at the second cover portion, the inner container is non-displaceable with respect to the thermal shield.

Preferably, the fixed bearing of the inner container is provided on the second cover portion. A floating bearing is provided on the first cover portion.

According to a further embodiment, the thermal shield completely encloses the inner container.

In particular, the thermal shield is also arranged between the inner container and the coolant container. This ensures that the inner container is completely surrounded by surfaces which are at a temperature corresponding to the boiling point of the cryogenic liquid, in particular nitrogen. Consequently, the helium holding time is increased significantly.

Further possible implementations of the transport container also comprise combinations not explicitly specified of features or embodiments described above or below with regard to the exemplary embodiments. A person skilled in the art will also add individual aspects as improvements or supplementations to the respective basic form of the transport container.

BRIEF DESCRIPTION OF THE DRAWINGS

Further advantageous configurations of the transport container form the subject matter of the dependent claims and of the exemplary embodiments of the transport container described below. The transport container will be explained in detail hereinafter on the basis of preferred embodiments with reference to the appended figures, in which:

In the figures, elements that are identical or have the same function have been provided with the same reference signs, unless stated otherwise.

Figure 1:
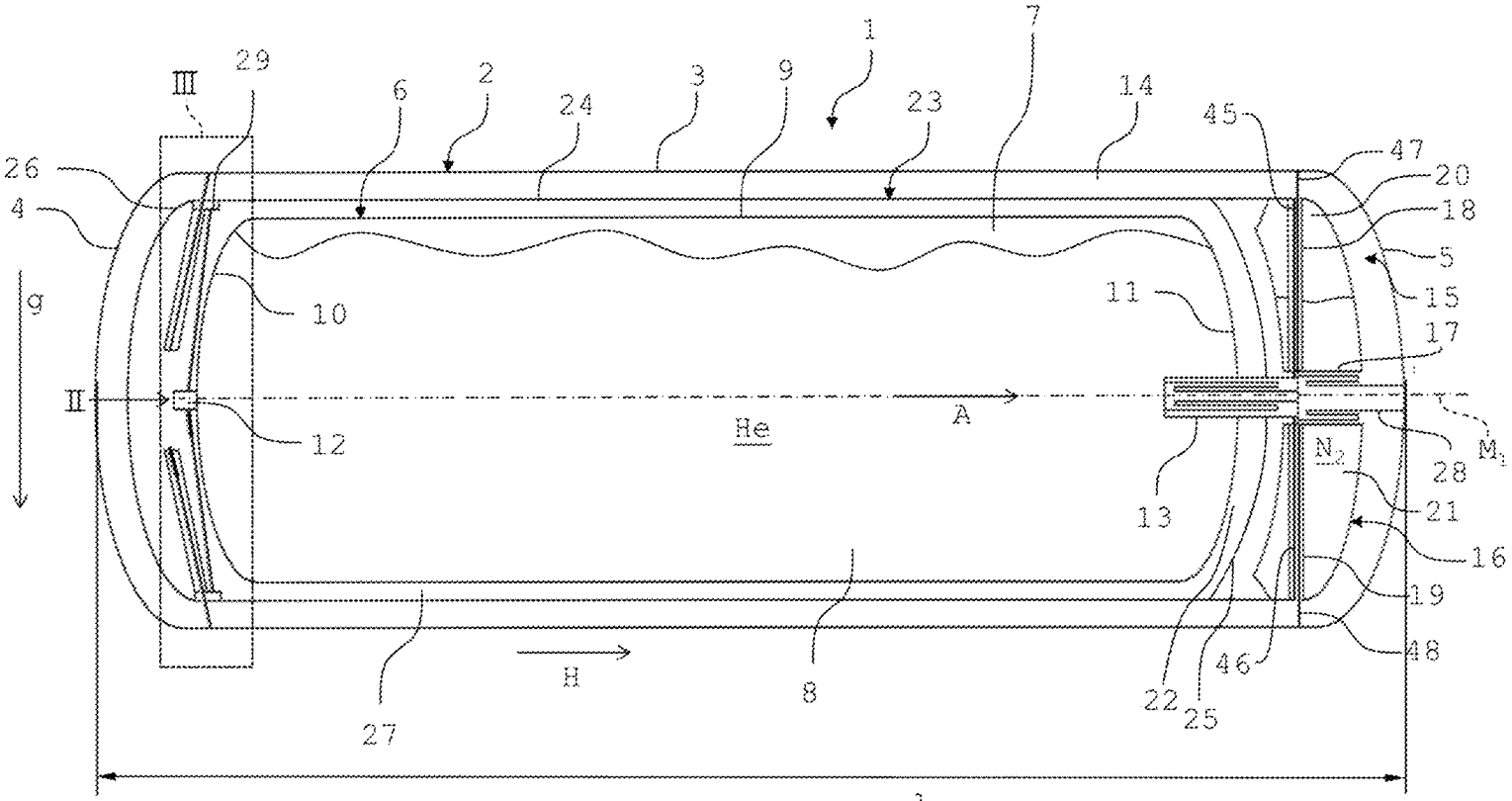
FIG. 1 shows a schematic sectional view of one embodiment of a transport container.
Figure 2:
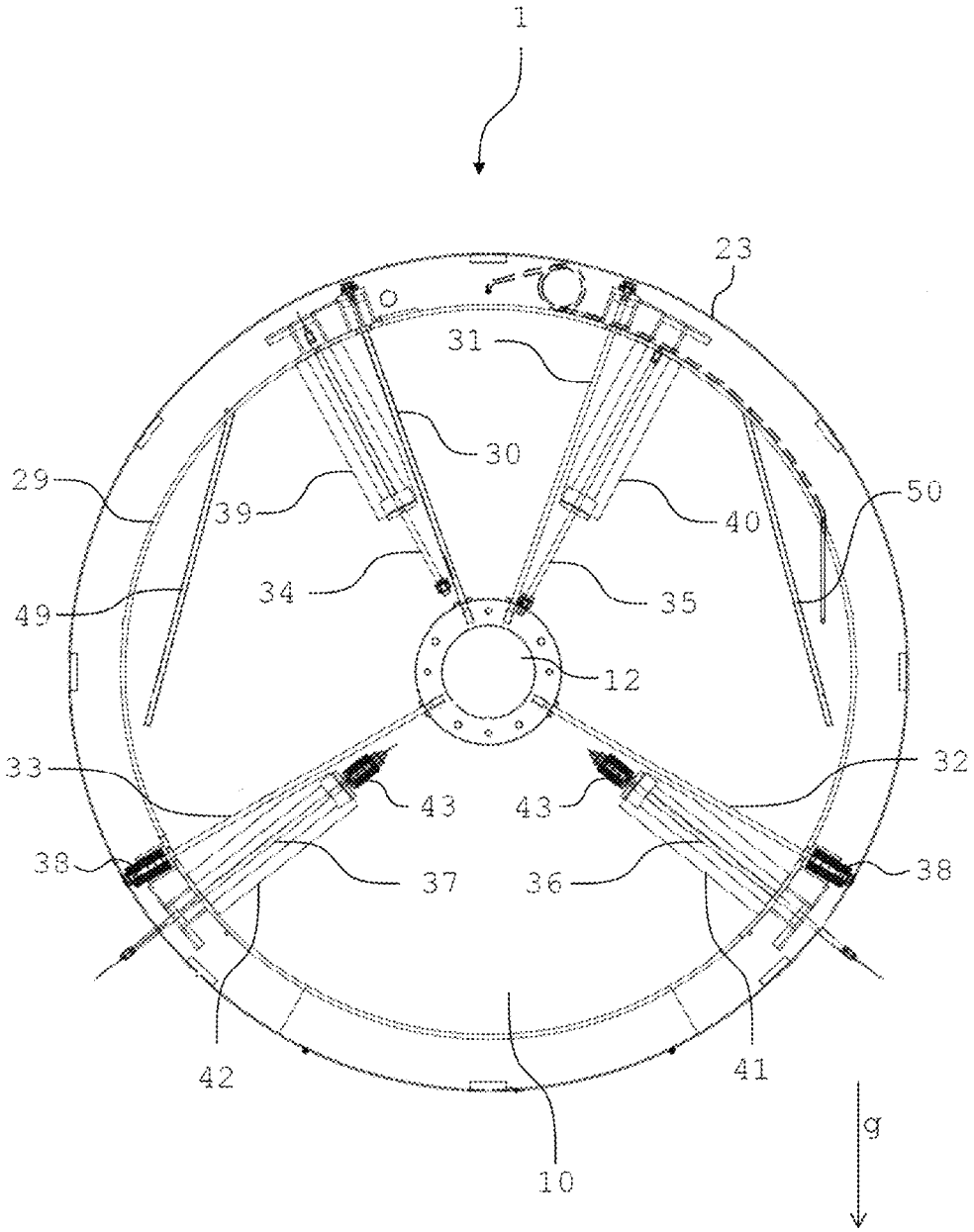
FIG. 2 shows the view II as per FIG. 1.
Figure 3:
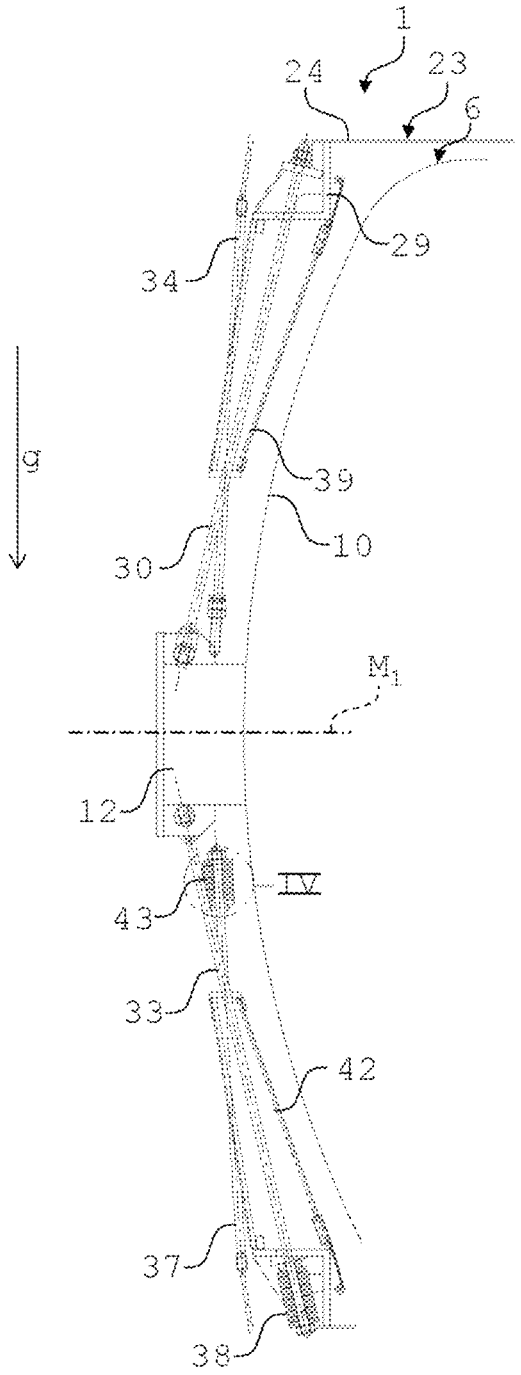
FIG. 3 shows the detail view III as per FIG. 1.
Figure 4:
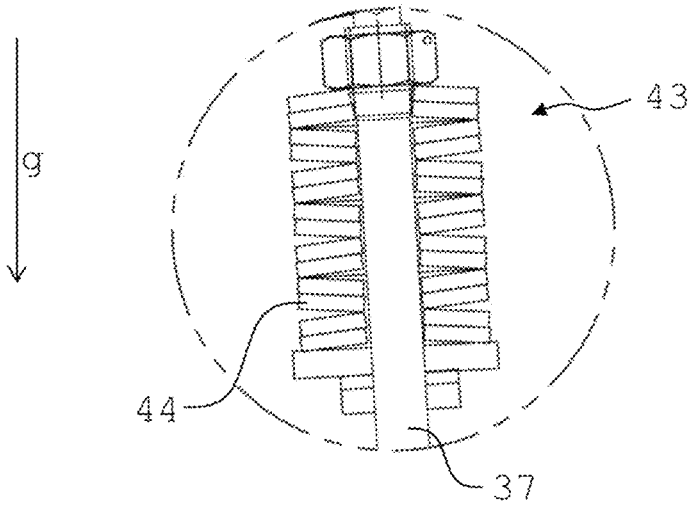
FIG. 4 shows the detail view IV as per FIG. 3.

FIG. 1 shows a highly simplified schematic sectional view of one embodiment of a transport container 1 for liquid or cryogenic helium He. FIG. 2 shows a front view of the transport container 1 as per the view II in FIG. 1. FIG. 3 shows the detail view III as per FIG. 1, and FIG. 4 shows the detail view IV as per FIG. 3. In the following text, reference is made to FIGS. 1 to 4 simultaneously.

The transport container 1 may also be referred to as a helium transport container. The transport container 1 may also be used for other cryogenic liquids. Examples of cryogenic liquids, or cryogens for short, are the previously mentioned liquid helium He (boiling point at 1 bara: 4.222 K=−268.928° C.), liquid hydrogen $H_2$ (boiling point at 1 bara: 20.268 K=−252.882° C.), liquid nitrogen $N_2$ (boiling point at 1 bara: 77.35 K=−195.80° C.) or liquid oxygen $O_2$ (boiling point at 1 bara: 90.18 K=−182.97° C.).

The transport container 1 comprises an outer container 2. The outer container 2 is produced for example from high-grade steel. The outer container 2 may have a length $l_2$ of for example 10 meters. The outer container 2 comprises a tubular or cylindrical base portion 3, which is closed at each of both the end faces with the aid of a cover portion 4, 5, in particular with the aid of a first cover portion 4 and a second cover portion 5. The base portion 3 may have a circular or approximately circular geometry in cross section. The cover portions 4, 5 are curved. The cover portions 4, 5 are curved in opposite directions such that both cover portions 4, 5 are outwardly curved with respect to the base portion 3. The outer container 2 is fluid-tight, in particular gas-tight. The outer container 2 has an axis of symmetry or center axis $M_1$, in relation to which the outer container 2 is constructed rotationally symmetrically.

The transport container 1 also comprises an inner container 6 for receiving the liquid helium He. The inner container 6 is likewise produced for example from high-grade steel. As long as the helium He is in the two-phase region, a gas zone 7 with evaporated helium He and a liquid zone 8 with liquid helium He may be provided in the inner container 6. The inner container 6 is fluid-tight, in particular gas-tight, and may comprise a blow-off valve for controlled pressure reduction. Like the outer container 2, the inner container 6 comprises a tubular or cylindrical base portion 9, which is closed at both end faces by cover portions 10, 11, in particular a first cover portion 10 and a second cover portion 11. The base portion 9 may have a circular or approximately circular geometry in cross section.

A cylindrical fastening flange 12 may be provided on the first cover portion 10. An axial fastening point 13, which may be of tubular form, may be provided on the second cover portion 11. The cover portions 10, 11 are curved in opposite directions such that they are outwardly curved with respect to the base portion 9.

Like the outer container 2, the inner container 6 is formed rotationally symmetrically in relation to the center axis $M_1$. An intermediate space 14 provided between the inner container 6 and the outer container 2 is evacuated. The inner container 6 may also have an insulating element (not shown in FIGS. 1 to 4). The insulating element has, on the outside, a highly reflective copper layer, for example a copper foil or an aluminum foil with a vapor-deposited copper coating, and a multilayered insulating layer arranged between the inner container 6 and the copper layer. The insulating layer comprises multiple alternately arranged layers of perforated and embossed aluminum foil, as a reflector, and glass paper, as a spacer, between the aluminum foils. The insulating layer may comprise 10 layers. The layers of aluminum foil and glass paper are applied on the inner container 6 without any gaps, that is to say are pressed. The insulating layer may be a so-called MLI (multilayer insulation). The inner container 6 and also the insulating element are, on the outside, approximately at a temperature corresponding to the temperature of the helium He.

The transport container 1 also comprises a cooling system 15 with a coolant container 16. The coolant container 16 is preferably likewise constructed rotationally symmetrically in relation to the center axis $M_1$. The coolant container 16 has, in the center, an aperture 17 which extends in the direction of the center axis $M_1$. The coolant container 16 also has four apertures 18, 19, of which merely two apertures 18, 19 extending in a direction of gravitational force g are shown in FIG. 1. A cryogenic liquid, in particular nitrogen $N_2$, is accommodated in the coolant container 16. A gas zone 20 with evaporated nitrogen $N_2$ and a liquid zone 21 with liquid nitrogen $N_2$ may be provided in the coolant container 16.

The coolant container 16 is arranged next to the inner container 6 in an axial direction A of the inner container 6. Like the inner container 6, the coolant container 16 is positioned inside the outer container 2. An intermediate space 22, which may be part of the intermediate space 14, is provided between the inner container 6, in particular the cover portion 11 of the inner container 6, and the coolant container 16. That is to say, the intermediate space 22 is likewise evacuated.

The transport container 1 also comprises a thermal shield 23 assigned to the cooling system 15. The thermal shield 23 is arranged in the evacuated intermediate space 14 provided between the inner container 6 and the outer container 2. The thermal shield 23 is actively coolable or actively cooled with the aid of the liquid nitrogen $N_2$ which is accommodated in the coolant container 16. "Active cooling" is to be understood in the present case as meaning that, for cooling the thermal shield 23, the liquid nitrogen $N_2$ is passed through, or passed along, said shield. Here, the thermal shield 23 is cooled down to a temperature which corresponds approximately to the boiling point of the nitrogen $N_2$.

The thermal shield 23 comprises a cylindrical or tubular base portion 24, which is closed on both sides by a cover portion 25, 26 closing it off at the end face. Both the base portion 24 and the cover portions 25, 26 are actively cooled with the aid of the nitrogen $N_2$. Alternatively, the cover portions 25, 26 are connected to the base portion 24 in an integrally bonded manner, with the result that the cooling of the cover portions 25, 26 can be realized by heat conduction. The base portion 24 may have a circular or approximately circular geometry in cross section. The thermal shield 23 is preferably likewise constructed rotationally symmetrically in relation to the center axis $M_1$. A first cover portion 25 of the thermal shield 23 is arranged between the inner container 6, in particular the cover portion 11 of the inner container 6, and the coolant container 16. A second cover portion 26 of the thermal shield 23 faces away from the coolant container 16. The thermal shield 23 is in this case self-supporting. That is to say that the thermal shield 23 is not supported on either the inner container 6 or the outer container 2.

The thermal shield 23 is fluid-permeable. That is to say that an intermediate space 27 between the inner container 6 and the thermal shield 23 is in fluid connection with the intermediate space 14. As a result, the intermediate spaces 14, 27 can be evacuated simultaneously. Bores, apertures or the like may be provided in the thermal shield 23, in order to allow evacuation of the intermediate spaces 14, 27. The thermal shield 23 is preferably produced from a high-purity aluminum material.

The first cover portion 25 of the thermal shield 23 shields the cooling container 16 completely from the inner container 6. That is to say, when looking in the direction from the inner container 6 toward the coolant container 16, the coolant container 16 is completely covered by the first cover portion 25 of the thermal shield 23. In particular, the thermal shield 23 completely encloses the inner container 6. That is to say, the inner container 6 is arranged completely inside the thermal shield 23, wherein, as already mentioned above, the thermal shield 23 is not fluid-tight.

The thermal shield 23 comprises at least one, but preferably multiple, cooling lines for actively cooling it. For example, the thermal shield 23 may have six cooling lines. The cooling line(s) is/are in fluid connection with the coolant container 16 such that the liquid nitrogen $N_2$ can flow into the cooling line(s) from the coolant container 16. The cooling system 15 may also comprise a phase separator (not shown), which is set up to separate gaseous nitrogen $N_2$ from liquid nitrogen $N_2$. With the aid of the phase separator, it is possible for gaseous nitrogen $N_2$ forming during the boiling of the liquid nitrogen $N_2$ to be blown off from the cooling system 15.

The cooling line(s) is/are provided both on the base portion 24 and on the cover portions 25, 26 of the thermal shield 23. Alternatively, the cover portions 25, 26 may be connected to the base portion 24 in an integrally bonded manner, with the result that the cooling of said cover portions is realized by heat conduction. The cooling line(s) has/have a gradient with respect to a horizontal H, which is arranged perpendicular to the direction of gravitational force g. In particular, the cooling line(s) includes/include an angle of greater than 3° with the horizontal H.

A further multilayered insulating layer, in particular an MLI, may be arranged between the thermal shield 23 and the outer container 2, which insulating layer completely fills the intermediate space 14 and thus makes contact with the outside of the thermal shield 23 and the inside of the outer container 2. In contrast to the above-described insulating element of the inner container 6, in this case, layers of aluminum foil, as a reflector, and glass silk, glass paper or glass mesh fabric of the insulating layer are introduced loosely into the intermediate space 14. "Loosely" means here that the layers of aluminum foil and of glass silk, glass paper or glass mesh fabric are not pressed, with the result that the embossing and perforation of the aluminum foil allows the insulating layer, and consequently the intermediate space 14, to be evacuated without any problem. An undesired mechanical-thermal contact between the aluminum foil layers is also reduced. This contact could disturb the temperature gradient, established by radiation exchange, of the aluminum foil layers.

The thermal shield 23 is arranged peripherally spaced apart from the copper layer of the insulating element of the inner container 6 and does not make contact with it. As a result, the heat input by radiation is reduced to the minimum physically possible. A gap width of a gap provided between the copper layer and the thermal shield 23 may be 10 mm. Consequently, heat can be transferred from the surfaces of the inner container 6 to the thermal shield 23 only by radiation and residual gas conduction.

The inner container 6 is connected fixedly to the outer container 2 at an end portion assigned to the first cover portion 11. That is to say, at the second cover portion 11, the inner container 6 is non-displaceable with respect to the thermal shield 23 and the outer container 2. Provided on the outer container 2 is an in particular tubular fastening point 28 which is connected to the fastening point 13. The fastening points 13, 28 are led through the aperture 17 provided in the coolant container 16. The coolant container 16 is also axially fixed in the outer container 2.

The thermal shield 23 comprises a carrying ring 29, which is assigned to the first cover portion 10 of the inner container 6. The carrying ring 29 may be connected for example to the base portion 24 of the thermal shield 23 in an integrally bonded manner. The inner container 6 is suspended from the carrying ring 29 via the fastening flange 12 with the aid of first suspension rods 30 to 33. The first suspension rods 30 to 33 are in particular tension rods. There may be any number of first suspension rods 30 to 33. For example, it is possible to provide four such first suspension rods 30 to 33, which are arranged in a star shape. The first suspension rods 30 to 33 may be arranged so as to be distributed non-uniformly over a circumference of the carrying ring 29. Two first suspension rods 32, 33 are arranged below the center axis $M_1$ with respect to the direction of gravitational force g. Two further first suspension rods 30, 31 are arranged above the center axis $M_1$ with respect to the direction of gravitational force g. The first suspension rods 30 to 33 are each led from the fastening flange 12 toward the carrying ring 29 and connect the carrying ring 29 to the fastening flange 12.

Also, the carrying ring 29 is suspended from the outer container 2 with the aid of second suspension rods 34 to 37. The second suspension rods 34 to 37 are preferably likewise arranged in a star shape and may be arranged so as to be distributed non-uniformly over the circumference of the carrying ring 29. There may be any number of second suspension rods 34 to 37. As an example, four such second suspension rods 34 to 37 are provided. Two of the second suspension rods 36, 37 are arranged below the center axis $M_1$ with respect to the direction of gravitational force g. Two further second suspension rods 34, 35 are positioned above the center axis $M_1$ with respect to the direction of gravitational force g.

At least one of the first suspension rods 32, 33 has a first spring device 38. Preferably, the two first suspension rods 32, 33 which are arranged below the center axis $M_1$ with respect to the direction of gravitational force g each have one such spring device 38. Those first suspension rods 30, 31 which are arranged above the center axis $M_1$ with respect to the direction of gravitational force g do not have such a first spring device 38.

The carrying ring 29 comprises multiple pockets 39 to 42, with a second suspension rod 34 to 37 being accommodated in each pocket 39 to 42. The pockets 39 to 42 extend from the carrying ring 29 radially inward toward the fastening flange 12. The second suspension rods 34 to 37 are each supported on the pocket 39 to 42 assigned thereto. Consequently, the carrying ring 29 is suspended from the outer container 2 via the pockets 39 to 42 and the second suspension rods 34 to 37. In FIGS. 2 and 3, the second suspension rods 34, 35 are shown in an assembly position in which they are not yet supported against the pockets 39, 40 assigned to them. Following the assembly of the transport container 1, nuts provided on the second suspension rods 34, 35 make contact with the pockets 39, 40.

Second spring devices 43 are respectively provided on the two second suspension rods 36, 37 which are provided below the center axis $M_1$ with respect to the direction of gravitation force g. The first spring devices 38 and the second spring devices 43 are of identical construction in principle. The second spring devices 43 are supported on the pockets 41, 42. Those second suspension rods 34, 35 which are arranged above the center axis $M_1$ with respect to the direction of gravitational force g do not have such spring devices 43. In FIG. 3, the second suspension rod 37 is shown in an assembly position in which the second spring device 43 makes no contact with the pocket 42. Following the assembly of the transport container 1, the second spring device 43 makes contact with the pocket 42.

With the aid of the pockets 39 to 42, it is possible for the largest possible mechanical length of the second suspension rods 34 to 37 to be achieved. In this way, the heat conduction path from the outer container 2 toward the carrying ring 29 is as long as possible, as a result of which the heat input to the thermal shield 23 can be reduced. With the aid of the spring devices 38, 43, a spring pretension of the first suspension rods 32, 33 and the second suspension rods 36, 37 can be ensured for different heat expansions of the inner container 6 and the thermal shield 23.

FIG. 4 shows an enlarged detail view of the second spring device 43. Each of the spring devices 38, 43 has a multiplicity of disk spring assemblies or disk spring elements 44, of which merely one is provided with a reference sign in FIG. 4. Each disk spring element 44 comprises one, two or more curved disk springs which are placed one above the other. Adjacent disk spring elements 44 are arranged such that they are oppositely curved. In this way, it is possible for the desired spring action to be achieved.

Returning now to FIG. 1, on the second cover portion 11 of the inner container 6, there are provided four third suspension rods 45, 46, which are arranged in a star shape and of which merely two are shown in FIG. 1. With the aid of the third suspension rods 45, 46, the inner container 6 is suspended from the thermal shield 23 or the coolant container 16. The thermal shield 23 is in turn suspended from the outer container 2 via fourth suspension rods 47, 48, of which merely two are shown in FIG. 1. For the fastening of the suspension rods 45 to 48, a further carrying ring may also be provided. The suspension rods 45 to 48 are led through the apertures 18, 19 provided in the coolant container 16.

The transport container 1 also comprises multiple rotation-prevention means 49, 50, which prevent rotation of the inner container 6 with respect to the carrying ring 29. The rotation-prevention means 49, 50 are formed for example as steel strips. In particular, the rotation-prevention means 49, 50 are, by one end, each connected fixedly to the cover portion 10 of the inner container 6 and, by the other end, connected fixedly to the carrying ring 29.

The functioning of the transport container 1 will be explained in summary below. Before the filling of the inner container 6 with the liquid helium He, firstly the thermal shield 23 is cooled down with the aid of cryogenic, initially gaseous and later liquid, nitrogen $N_2$ at least approximately or right up to the boiling point (at 1.3 bara: 79.5 K) of the liquid nitrogen $N_2$. The inner container 6 is in this case not yet actively cooled. During the cooling down of the thermal shield 23, the residual vacuum gas still situated in the intermediate space 14 is frozen out on the thermal shield 23. In this way, when filling the inner container 6 with the liquid helium He, it can be prevented that the residual vacuum gas is frozen out on the outside of the inner container 6 and thereby contaminates the metallically bright surface of the copper layer of the insulating element of the inner container 6. As soon as the thermal shield 23 and the coolant container 16 have cooled down completely and the coolant container 16 is again filled with nitrogen $N_2$, the inner container 6 is filled with the liquid helium He.

Since initially the thermal shield 23 is cooled down and the inner container 6 is not yet filled with helium He, a difference in length between the cooled thermal shield 23 and the inner container 6 arises, firstly owing to the different temperatures and secondly owing to the different heat expansion coefficients of the materials of the thermal shield 23, namely aluminum, and the material of the inner container 6, namely high-grade steel. This can lead to relative movements between the thermal shield 23 and the inner container 6. The thermal stresses brought about by the relative movement between the thermal shield 23 and the inner container 6 are significantly larger than those stresses which occur at the operating temperature of the transport container 1 and which are dominated by the difference between the thermal heat expansion coefficients of aluminum and high-grade steel.

These stresses during the start-up can no longer be absorbed by the elastic deformations of the first and second suspension rods 30 to 37, but rather a plastic deformation, that is to say a lasting extension of the suspension rods 30 to 37, occurs. Here, the inner container 6 can sag slightly and thus be slightly oblique in relation to the center axis $M_1$. With the aid of the spring devices 38, 43, however, it is ensured that the suspension rods 30 to 37 do not actually undergo any significant plastic deformation and are continually under tensile stress. The spring devices 38, 43 thus prevent the respective two lower suspension rods 32, 33, 36, 37 from becoming loose. This in turn prevents the inner container 6 from becoming loose inside the outer container 2, as a result of which the occurrence of additional acceleration forces, for example when the transport container 1 is transported, is reliably prevented. Further plastic deformations of the suspension rods 30 to 37 owing to said acceleration forces can thus be prevented with the aid of the spring devices 38, 43 by the spring pretension. In this way, it is possible to prevent the inner container 6 from sagging to too great an extent in the outer container 2 or the suspension rods 30 to 37 from breaking and thus the transport container 1 from being damaged.

Although the present invention has been described using exemplary embodiments, it is modifiable in various ways.

REFERENCE SIGNS USED

1 Transport container
2 Outer container
3 Base portion
4 Cover portion
5 Cover portion
6 Inner container
7 Gas zone
8 Liquid zone
9 Base portion
10 Cover portion
11 Cover portion
12 Fastening flange
13 Fastening point
14 Intermediate space
15 Cooling system
16 Coolant container
17 Aperture
18 Aperture
19 Aperture
20 Gas zone
21 Liquid zone
22 Intermediate space
23 Shield
24 Base portion
25 Cover portion
26 Cover portion
27 Intermediate space
28 Fastening point
29 Carrying ring
30 Suspension rod
31 Suspension rod
32 Suspension rod
33 Suspension rod
34 Suspension rod
35 Suspension rod
36 Suspension rod
37 Suspension rod
38 Spring device
39 Pocket
40 Pocket
41 Pocket
42 Pocket
43 Spring device
44 Disk spring element
45 Suspension rod
46 Suspension rod
47 Suspension rod
48 Suspension rod
49 Rotation-prevention means
50 Rotation-prevention means
A Axial direction
g Direction of gravitational force
H Horizontal
He Helium
$H_2$ Hydrogen
$l_2$ Length
$M_1$ Central axis
$N_2$ Nitrogen
$O_2$ Oxygen

The invention claimed is:

1. A transport container for helium
an inner container for receiving the helium,
a thermal shield which is actively coolable with the aid of a cryogenic liquid and in which the inner container is accommodated,
an outer container in which the thermal shield and the inner container are accommodated, and
a carrying ring provided on the thermal shield,
wherein the inner container is suspended from the carrying ring with the aid of first suspension rods, and the carrying ring is suspended from the outer container with the aid of second suspension rods,
wherein at least one of the first suspension rods has a first spring device and at least one of the second suspension rods has a second spring device in order to ensure a spring pretension of the first suspension rods and the second suspension rods for different heat expansions of the inner container and the thermal shield.

2. The transport container as claimed in claim 1, wherein the transport container has a central axis and the first suspension rods are spaced from one another and extend radially inward from the carrying ring toward the central axis and the second suspension rods are spaced from one another and extend radially inward from the outer container toward the central axis.

3. The transport container as claimed in claim 1, wherein the first spring device and the second spring device each have multiple disk spring elements.

4. The transport container as claimed in claim 1, wherein in each case four first suspension rods and four second suspension rods are provided.

5. The transport container as claimed in claim 1, wherein the at least one first suspension rod which has the first spring device is arranged below a center axis of the outer container with respect to a direction of gravitational force.

6. The transport container as claimed in claim 5, wherein two first suspension rods which each have a first spring device are arranged below the center axis of the outer container with respect to the direction of gravitational force.

7. The transport container as claimed in claim 5, wherein the at least one second suspension rod which has the second spring device is arranged below the center axis of the outer container with respect to the direction of gravitational force.

8. The transport container as claimed in claim 7, wherein two second suspension rods which each have a second spring device are arranged below the center axis of the outer container with respect to the direction of gravitational force.

9. The transport container as claimed in claim 1, wherein the carrying ring has pockets in which the second suspension rods are arranged.

10. The transport container as claimed in claim 1, wherein the inner container has a fastening flange to which the first suspension rods are fastened.

11. The transport container as claimed in claim 1, wherein the carrying ring, the first suspension rods and the second suspension rods are assigned to a first cover portion of the inner container.

12. The transport container as claimed in claim 11, wherein the inner container is suspended at a second cover portion from the thermal shield with the aid of third suspension rods, and wherein the thermal shield is suspended at the second cover portion from the outer container with the aid of fourth suspension rods.

13. The transport container as claimed in claim 12, wherein the third suspension rods (45, 46) and the fourth suspension rods are led through a coolant container in which the cryogenic liquid is accommodated.

14. The transport container as claimed in claim 13, wherein, at the second cover portion, the inner container is non-displaceable with respect to the thermal shield.

15. The transport container as claimed in claim 1, wherein the thermal shield completely encloses the inner container.

16. The transport container as claimed in claim 1, further comprises a coolant container containing cryogenic liquid.

17. The transport container as claimed in claim 5, wherein first suspension rods arranged above the center axis of the outer container with respect to a direction of gravitational force do not have said first spring devices.

18. The transport container as claimed in claim 7, wherein the second suspension rods arranged above the center axis of the outer container with respect to a direction of gravitational force do not have said second spring devices.

19. The transport container as claimed in claim 10, wherein the transport container has a central axis and the first suspension rods each of a first end and a second end, wherein each of the first suspension rods is fastened at the first end to the fastening flange of the inner container and fastened at the second end to the carrying ring, and wherein the each of the first suspension rods extends radially outwardly with respect to the central axis.

20. The transport container as claimed in claim 16, wherein the outer container has a first cover portion and a second cover portion, the inner container has a first cover portion and a second cover portion, and said thermal shield has a first cover portion and a second cover portion, said coolant container being arranged between said second cover portion of the outer container and said second cover portion of said inner container, and said second cover portion of the thermal shield being arranged between said second cover portion of said inner container and said coolant container.

* * * * *